US012330699B2

(12) United States Patent
De Faria Antunes et al.

(10) Patent No.: US 12,330,699 B2
(45) Date of Patent: Jun. 17, 2025

(54) MONITORING SYSTEM OF A RAILROAD AXLE AND PERIPHERALS

(71) Applicant: VALLOUREC TUBOS DO BRASIL LTDA, Belo Horizonte (BR)

(72) Inventors: Ronaldo De Faria Antunes, Belo Horizonte (BR); Antônio Sérgio Medeiros Fonseca, Belo Horizonte (BR); Diego Silva Melo, Belo Horizonte (BR)

(73) Assignee: Vallourec Tubos do Brasil Ltda., Belo Horizonte (BR)

( * ) Notice: Subject to any disclaimer, the term of this patent is extended or adjusted under 35 U.S.C. 154(b) by 968 days.

(21) Appl. No.: 17/286,063

(22) PCT Filed: Oct. 18, 2019

(86) PCT No.: PCT/BR2019/050452
§ 371 (c)(1),
(2) Date: Apr. 16, 2021

(87) PCT Pub. No.: WO2020/077429
PCT Pub. Date: Apr. 23, 2020

(65) Prior Publication Data

US 2021/0380149 A1 Dec. 9, 2021

(30) Foreign Application Priority Data

Oct. 19, 2018 (BR) ..... 102018071610-7

(51) Int. Cl.
*B61L 15/00* (2006.01)
*B61K 9/04* (2006.01)

(52) U.S. Cl.
CPC ..... *B61L 15/0081* (2013.01); *B61K 9/04* (2013.01); *B61L 15/0027* (2013.01)

(58) Field of Classification Search
CPC .... B61L 15/0081; B61L 15/0027; B61K 9/04
See application file for complete search history.

(56) References Cited

U.S. PATENT DOCUMENTS 1,979,875 A * 11/1934 Faus ..... B61K 9/04 116/214
2009/0284362 A1* 11/2009 Wilson ..... B60C 23/00336 340/449

(Continued)

FOREIGN PATENT DOCUMENTS

| | | |
|---|---|---|
| EP | 3354532 | 8/2018 |
| JP | 2018-001950 | 1/2018 |
| WO | WO 2018/141315 | 8/2018 |

OTHER PUBLICATIONS

"Railway applications—Wheelsets and bogies—Axles—Product requirements," NSAI, 2010, 10 pages.

(Continued)

*Primary Examiner* — Zachary L Kuhfuss
(74) *Attorney, Agent, or Firm* — Sheridan Ross P.C.

(57) ABSTRACT

The present invention refers to a system for monitoring a railroad axle and its peripherals comprising a steel axle (10), and at least one monitoring device (20) coupled to the axle and its elements (10), wherein the at least one monitoring device (20) performs measurements of data indicative of monitored conditions of the axle (10) and its peripherals, and transmits the measurements to at least one remote point.

16 Claims, 2 Drawing Sheets

(56) References Cited

U.S. PATENT DOCUMENTS

| | | | | |
|---|---|---|---|---|
| 2016/0152255 | A1* | 6/2016 | Cuthbertson | B61L 25/06<br>701/19 |
| 2020/0023868 | A1* | 1/2020 | Falta | H02K 21/26 |

OTHER PUBLICATIONS

International Search Report and Written Opinion for International (PCT) Patent Application No. PCT/BR2019/050452, dated Mar. 2, 2020, 11 pages.

* cited by examiner

MONITORING SYSTEM OF A RAILROAD AXLE AND PERIPHERALS

CROSS REFERENCE TO RELATED APPLICATIONS

This application is a national stage application under 35 U.S.C. 371 and claims the benefit of PCT Application No. PCT/BR2019/050452 having an international filing date of 18 Oct. 2019, which designated the United States, which PCT application claimed the benefit of Brazilian Patent Application No. BR102018071610-7 filed 19 Oct. 2018, the contents of each of which are incorporated herein by reference in their entireties.

The present invention refers to a system for monitoring a railroad axle, which enables more frequent, precise and reliable monitoring of operating conditions of the railroad axle and its peripherals along the track of the railway line.

DESCRIPTION OF THE STATE OF THE ART

Monitoring the service conditions of a railway transport vehicle is critical in accident prevention and maintenance planning, improving reliability and reducing costs.

Currently, these measurements are performed by means of sensors arranged nearby or on the railway line itself along the railway track, however, the ratio of sensors in relation to the size of a track is still very low due to high costs and the difficulty of maintaining them along extensive railway tracks. In addition, a same train can travel on lines owned by different companies with large differences in infra-structure and operation monitoring systems, so a railway line independent system is desirable.

An insufficient number of devices on the line compromises vehicle tracking and safety, as it is likely that a wagon may present a failure in a section between sensors, leading to an accident before it can be detected. On the other hand, the increase in the number of sensors along the railway tracks would result in considerable increase in costs. And even the increase in the number of sensors may not prevent problems on the railway vehicles, since the interval between the appearance of the problem (for example, overheating of a bearing of the railroad axle) and the occurrence of a railway accident may be significantly short. For example, when overheating of a bearing of the axle called "Hotbox" occurs, this bearing may lock, making the axle melt and break, even causing the derailing of the railway vehicle. This factor is the cause of serious accidents and operational interruptions of railway lines, stopping the flow of vehicles.

In addition, currently alternative sensors embedded in wagons are temporary solutions, because they are exposed and subject to weathering, acts of vandalism or potential accidents, generating extra cost with the maintenance thereof. Another technical difficulty is the power supply of these sensors in the wagons, mainly for long periods between maintenance shutdowns that can be more than years in some cases.

The prior art of railroad axle already comprises the concept of using hollow, punctured or tubular axle in passenger cars, high speed trains, locomotives and freight wagons, instead of solid axle that have greater quantity of material. The current technique enables the manufacture of tubular railroad axle, built of seamless tubes, but capable of achieving the same strength and other mechanical properties as solid axle with less consumption of raw materials. However, thus far, the use of solid axle is still commonplace in the railroad industry.

OBJECTIVES OF THE INVENTION

A first object of the invention is to provide a way of monitoring the condition of a railroad axle with greater accuracy, frequency and robustness than the current systems.

Another object of the invention is to increase the availability of the track and reduce maintenance costs of the railway lines and railway compositions by monitoring technical parameters and preventing defects in the railway vehicles, its peripherals and in the railway line not properly detected by the systems of the state of the art, and accidents caused by these defects.

BRIEF DESCRIPTION OF THE INVENTION

The objectives of the invention are achieved by a system for monitoring a railroad axle, that comprises:

- a steel axle, and at least a monitoring device attached to the axle,
- wherein at least one monitoring device performs measurements of data indicative of monitored conditions of the axle and its peripherals, and transmits the measurements to at least one remote point.

The at least one monitoring device may comprise at least one sensor, one microcontroller, one data transmitter, one power source and one storage unit. The device comprises at least one of a temperature sensor, accelerometer and gyroscope. The monitored conditions preferably comprise at least one of a bearing temperature, vibration due to jolts, strains, number of cycles, speed, position and discontinuities such as cracks. The measured data are transmitted by means of at least one of a mobile network, a wireless network, Bluetooth and radiofrequency.

The measurements can be performed at preset measurement time intervals or in real time.

The power source of the monitoring device can be one of a battery or an autonomous alternative source.

The monitoring device can communicate with and/or identify an RFID device arranged on at least one of the axle, a bogie and a wagon of a railroad vehicle.

The axle can be a seamless hollow tubular steel axle, and the at least one monitoring device is housed inside the axle, or inside a seat of a bearing of the axle. The axle can be a solid axle, and the at least one monitoring device is coupled to one end of the axle. The system can be embedded in any peripheral of the axle such as a cover, screw or adapter, for example. The axle made of solid bar may have a through-hole.

BRIEF DESCRIPTION OF THE DRAWINGS

For a better understanding, the features and advantages of the present invention will be disclosed and described together with their respective figures, which illustrate some preferred embodiments of the invention.

DETAILED DESCRIPTION OF THE INVENTION

Figure 3:
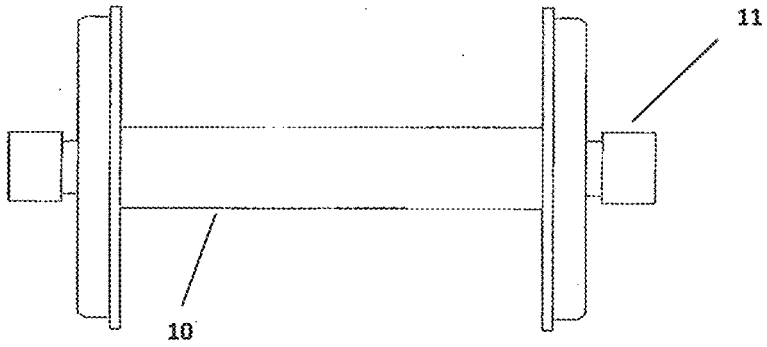
FIG. 3 is a perspective view of a railroad axle of the type used in the embodiment of the invention illustrated in FIG. 1, with wheels and bearings at its two ends, constituting a wheelset.

The system for monitoring a railroad axle according to the invention comprises a steel axle 10 used in railway vehicles, at whose ends there can be coupled a wheel and a bearing, as shown in FIG. 3. In the system according to the invention, at least one monitoring device 20 is coupled to the railroad axle 10, to monitor operating conditions of the axle at any time during its operation, and in any position of the track of the railway line. Accordingly, the monitoring device 20 performs measurements of data indicative of monitored conditions on the axle 10 and its components or peripherals (wagons and permanent line). Some possible conditions monitored by the monitoring devices are the axle and/or vehicle bearings temperature, the vibration due to jolts and other dynamic loads on the axle or on the wheel, strains on the axle, number of cycles, speed, position and discontinuities, such as cracks.

To measure these conditions, the monitoring device according to the invention may comprise sensors such as, for example, temperature sensors, accelerometers, gyroscopes, and others. Other types of sensors or meters may also be used in the monitoring device, depending on the type of condition for which monitoring is desirable. These devices, also known as transducers, may be contained in the same system casing or distributed along the axle and coupled to the wireless or wired system.

The representative data of these conditions are captured by the monitoring devices and transmitted to at least one remote point, for example, another sensor device, building a local network between sensors, a control center of the vehicle, of the locomotive or of the railway line, or an antenna arranged along the railway line which relays this data to a control center, and others. From the data sent, the control center or even an operator of the railway line with access to this remote point can interpret and know the monitored conditions, and send control signals back to the railway vehicle, or locomotive, in order to manage the operation of the vehicle according to said conditions. For example, if one of these conditions could endanger the operation of the vehicle, the signal is then sent to the vehicle with an order to stop.

Figure 4:
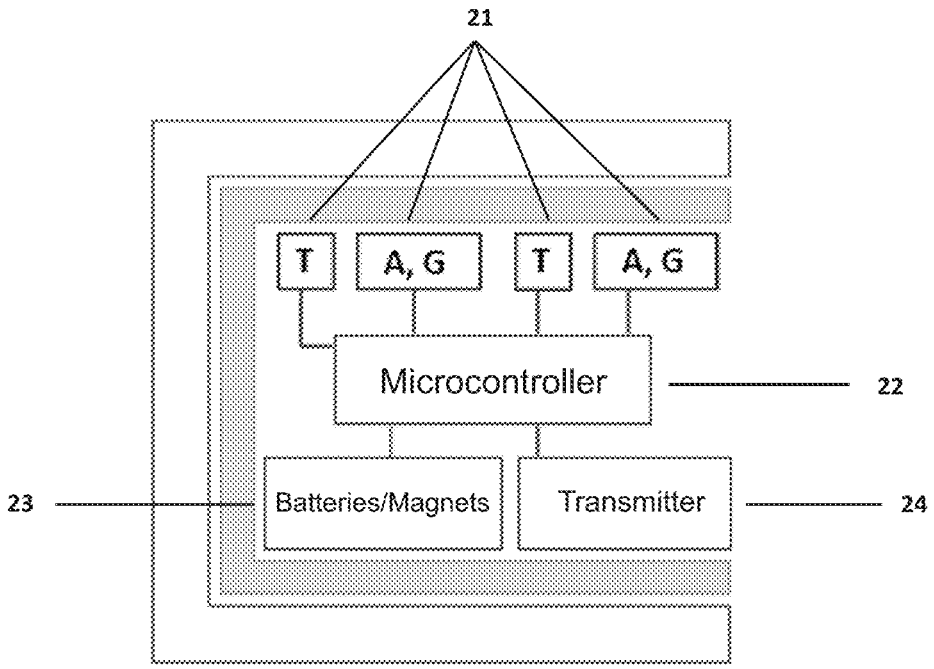
FIG. 4 shows a block diagram of the components of the monitoring device according to an embodiment of the present invention.

FIG. 4 shows a monitoring device 20 according to an embodiment of the invention, in which some temperature sensors T, accelerometers A and gyroscopes G are used to measure a condition of the axle. These sensors are connected to a microcontroller 22, responsible for processing the measured data and converting them into a storage or transmission format. This microcontroller may also control the operating intervals of the sensors, for measuring data corresponding to the monitored condition. The microcontroller is also connected to a transmitter 24 responsible for transmitting the measured data by the sensors to at least one remote point. The transmitter 24 communicates with the remote point using the technology of mobile networks, wireless networks, Bluetooth or any other form of wireless transmission. The intervals and the frequencies of data measuring and transmission to the remote point can be controlled and configured, either by a railway operator, or by a control center. These measurements can be performed at regular time intervals or in real time, can be stored in a storage unit in the monitoring device 20 and sent from time to time or can even be sent in real time to the remote point.

The monitoring device 20 further comprises a power source 23 to feed its components (not illustrated). This power source can be, for example, a battery or an autonomous alternative source that uses its own kinetic energy of the wheelset in movement, either by magnetic induction or another physical principle. The monitoring device 20 may also be adapted so as to communicate and/or identify a identification device by radio frequency (RFID—Radio-Frequency IDentification) coupled to any component of the railway vehicle in a location nearby, for example, on the axle itself, on the bogie, or in the wagon, for tracking and control purposes.

Figure 1:
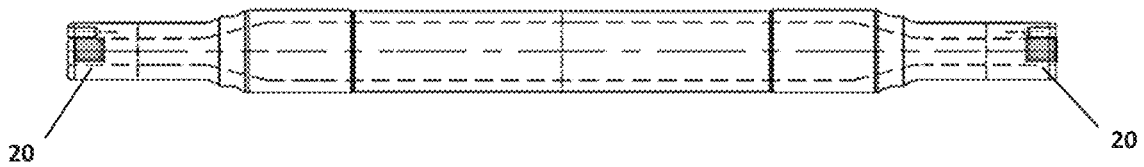
FIG. 1 shows a cross-sectional front view of a tubular railroad axle with the monitoring device in an embodiment of the system according to the present invention.
Figure 2:
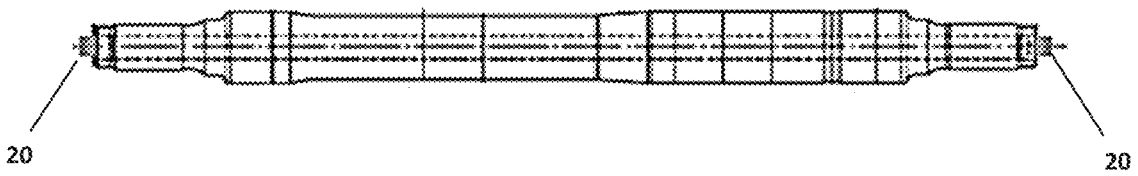
FIG. 2 shows a cross-sectional front view of a railroad axle (made of solid bar) with a machined inner through-hole (or otherwise) with the monitoring device in an embodiment of the system according to the present invention.

In the embodiment of the invention shown in FIG. 1, the railroad axle 10 is a seamless hollow tubular steel axle. In this embodiment, the monitoring device 20 is preferably housed inside the axle, where there is free space to install it, without interfering with the design or operation of the vehicle. Various monitoring devices can be installed in different positions inside the axle depending on the conditions to be monitored.

In this embodiment shown in FIG. 1, the monitoring device 20 is positioned inside the seat of the bearing 11 of the tubular axle 10 to perform the measurement of the temperature of the bearing of the tubular axle 10 in order to avoid overheating of the bearing, which may lead to the melting of the tubular axle and consequently to an emergency stop or to any accident. In this case, at least one temperature sensor inside the monitoring device 20 is used. The temperature sensor measures the temperature of the axle itself in the region near the bearing, which temperature will be very close to the temperature of the monitored bearing, which guarantees the accuracy and robustness of the system according to the invention compared to the systems of the state of the art installed along the railway lines which used to take perform measurements of conditions of the railway vehicle at greater distances and with obstacles.

In a possible way of operation of this embodiment of the invention, it is possible to set an upper limit for an acceptable temperature, for example, 90° C. The sensor monitors the temperature of the axle, and when it reaches or exceeds this upper limit, the monitoring device according to the invention outputs a signal indicating overheating to a control center or a control point. In response to this signal, the railway vehicle receives a stop command.

According to another embodiment not illustrated of the invention, the railroad axle 10 is a solid axle, preferably cylinder-shaped, with an inner hole machined at each end. The hole can be a through-hole, or otherwise. In this case, the monitoring device 20 is coupled to the end of the axle, being limited between the cover of the bearing and the end of the axle, where usually a small gap is formed, or even attached to or embedded in the cover. The system may also comprise two monitoring devices, each being coupled to one of the ends of the axle.

In any of the embodiments described herein, an advantage of this invention is that since the monitoring device 20 is positioned inside the tubular axle 10, or in the case of a solid axle, it is protected by the cover of the bearing, there is no risk of vandalism or the action of weathering that compromises the good operation of the system. This significantly increases the durability of the system according to the invention.

Another advantage is that it is possible to build a database with more parameters (temperature, acceleration and others), more accurate (inside the axle), on more points (all the bearings), at a greater frequency (intervals of seconds instead of hours), than was possible with current techniques, for subsequent analysis off-line, the possibilities of generating value for railway users being almost infinite.

What is claimed is:

1. A monitoring system of a railroad axle, the monitoring system comprising:

a steel axle; and at least one monitoring device coupled to the steel axle, the at least one monitoring device comprising a temperature sensor, an accelerometer, a gyroscope, one microcontroller, one data transmitter, one power source, and one storage unit for storing measurements, wherein the at least one monitoring device acquires measurements of data indicative of monitored conditions of the steel axle and peripherals of the steel axle, and transmits the measurements of data to at least one remote point, the monitored conditions comprising at least one of a bearing temperature, vibrations associated with jolts, strains, number of cycles, speed, position and discontinuities, wherein the steel axle is a seamless hollow tubular steel axle, and the at least one monitoring device is housed inside the steel axle, inside a seat of a bearing of the steel axle, or is embedded in any peripheral of the steel axle, and wherein the temperature sensor, the accelerometer, and the gyroscope are distributed along the steel axle and coupled to the monitoring system in wireless or wired form.

2. The monitoring system according to claim 1, wherein the measurements of data are transmitted by means of at least one of a mobile network, a wireless network, Bluetooth and radiofrequency.

3. The monitoring system according to claim 1, wherein the measurements of data are performed at preset measurement time intervals.

4. The monitoring system according to claim 1, wherein the measurements of data are performed in real time.

5. The monitoring system according to claim 1, wherein the one power source of the at least one monitoring device is one of a battery or an autonomous alternative source.

6. The monitoring system according to claim 1, wherein the at least one monitoring device communicates with and/or identifies an RFID device arranged on at least one of the steel axle, a bogie and a wagon of a railroad vehicle.

7. The monitoring system according to claim 1, wherein the steel axle is an axle made of solid bar, with an inner hole machined at least at one end.

8. The monitoring system according to claim 7, wherein the steel axle made of solid bar has a through-hole.

9. A monitoring system of a railroad axle, the monitoring system comprising:

a steel axle, wherein the steel axle is a solid steel axle; and at least one monitoring device coupled to the steel axle, the at least one monitoring device comprising a temperature sensor, an accelerometer, a gyroscope, one microcontroller, one data transmitter, one power source, and one storage unit for storing measurements, wherein the at least one monitoring device acquires measurements of data indicative of monitored conditions of the steel axle and peripherals of the steel axle, and transmits the measurements of data to at least one remote point, the monitored conditions comprising at least one of a bearing temperature, vibration associated with jolts, strains, number of cycles, speed, position, and discontinuities, and wherein the temperature sensor, the accelerometer, and the gyroscope are distributed along the steel axle and coupled to the monitoring system in wireless or wired form.

10. The monitoring system according to claim 9, wherein the at least one monitoring device is coupled to one end of the steel axle.

11. The monitoring system according to claim 9, characterized by being embedded in any peripheral of the steel axle.

12. The monitoring system according to claim 9, wherein the measurements of data are transmitted by means of at least one of a mobile network, a wireless network, Bluetooth and radiofrequency.

13. The monitoring system according to claim 9, wherein the measurements of data are performed at preset measurement time intervals.

14. The monitoring system according to claim 9, wherein the measurements of data are performed in real time.

15. The monitoring system according to claim 9, wherein the one power source of the at least one monitoring device is one of a battery or an autonomous alternative source.

16. The monitoring system according to claim 9, wherein the at least one monitoring device communicates with and/or identifies an RFID device arranged on at least one of the steel axle, a bogie and a wagon of a railroad vehicle.

* * * * *